United States Patent [19]

Skaggs

[11] Patent Number: 4,953,642

[45] Date of Patent: Sep. 4, 1990

[54] ROCK DRILL BIT

[76] Inventor: Roger D. Skaggs, 323 Church St., Bonne Terre, Mo. 63628

[21] Appl. No.: 326,079

[22] Filed: Mar. 20, 1989

[51] Int. Cl.[5] ..... E21B 10/44; E21B 10/60

[52] U.S. Cl. ..... 175/393; 175/394; 175/401; 175/408

[58] Field of Search ..... 175/320, 323, 325, 327, 175/393, 394, 395, 401, 408, 414, 415, 417, 418, 419; 408/229, 230, 226, 210, 59

[56] References Cited

U.S. PATENT DOCUMENTS

| | | | |
|---|---|---|---|
| 54,226 | 4/1866 | Smith | 175/401 X |
| 1,307,525 | 6/1919 | Trebert | 175/394 X |
| 1,542,880 | 6/1925 | Hobbs | 175/393 X |
| 1,703,390 | 2/1929 | Duffy | 175/394 |
| 1,734,469 | 11/1929 | Journeay | 175/401 |
| 1,734,672 | 11/1929 | Harralson | 175/393 |
| 1,955,768 | 4/1934 | Powell | 175/394 X |
| 2,215,494 | 9/1940 | Athy | 175/414 X |
| 2,519,861 | 8/1950 | Turner | 175/401 X |
| 2,728,558 | 12/1955 | Tengberg | 175/395 |
| 2,735,116 | 2/1956 | Mueller | 408/226 X |
| 2,821,364 | 1/1958 | Godfrey | 175/401 |
| 2,888,845 | 6/1959 | McClinton | 175/406 X |
| 3,145,789 | 8/1964 | Lawry | 175/401 X |
| 4,285,618 | 8/1981 | Shamley, Jr. | 408/230 X |

FOREIGN PATENT DOCUMENTS

| | | | |
|---|---|---|---|
| 493510 | 5/1950 | Belgium | 175/323 |
| 375221 | 5/1923 | Fed. Rep. of Germany | 175/394 |

*Primary Examiner*—Hoang C. Dang

*Attorney, Agent, or Firm*—Haverstock, Garrett & Roberts

[57] ABSTRACT

A rock drill bit having an elongated tubular body with a drilling head portion at one end and a trailing opposite end portion, the head end portion having attached hardened portions for engaging and drilling a work surface, at least one opening through the head end portion for drilling fluid to pass therethrough to the region of the drill face, at least one side of the bit having an axially extending cutout therealong forming an elongated passage with the surface of a bore being drilled through which the drilling fluid and drilling residue carried thereby can pass as it moves rearwardly along the drill bit away from the drill face, and transversely extending grooves formed in the portions of the body between the cutouts dividing the portions into a plurality of spaced outwardly extending body portions.

13 Claims, 1 Drawing Sheet

ROCK DRILL BIT

BACKGROUND OF THE INVENTION

Applicant has invented a novel rock reamer drill bit some times referred to as a rock drill bit which is capable of producing improved drilling operation an increased drilling efficiency which bit is less likely to bind, twist or break due to the accumulation of residue or other friction producing means between the bit body and the bore being drilled. It is the purpose of the present bit construction to provide means to stabilize the operation of drill bits during drilling operations, which bit increases the penetration rate, removes residue from therearound and reduces friction between the bit and the bore surface. This is accomplished with the present bit construction by providing means for facilitating the movement of drilling residue past the bit by pulverizing any such drilling residue including any fragments therein that are produced during drilling as the residue is carried away from the drilling face by the drilling fluid and as the residue moves between the outer surface of the bit body and the bore being drilled. This is done to minimize friction between the body of the bit and the surface being drilled. The present bit construction therefore facilitate removal of the drilling residue, minimizes the possibility for hang ups and binding or twisting due to material accumulating around the bit body and prevents accumulation of the drilling residue behind the bit thereby making it easier to drill and to remove the bit from a bore and it leaves a clean hole for placing a blasting agent. These are very important considerations for drill bits including bits used to drill into rock that forms a mine passage where the drilling is done to accommodate the placing of explosive charges to blast and loosen the surrounding rock. The construction of the present bit also substantially extends its useful life thereby representing a substantial savings to mine operators. The full body design of the present bit also holds the carbons in proper striking position, thereby extending the life of the bit.

In the past it has been the practice to construct drill bits for drilling into rock that have head portions of substantially larger diameter than the trailing tubular body portions. Such constructions use the annular space between the body portions of the bits and the bore surfaces as passages for the residue carried by the drilling fluid and produced during drilling. The tubular body portions of such drill bits receive the threaded end portions of a tubular drive rods used for rotating the drill bit during the drilling operation. However, the known bits have had no provision apart from the fluid used to facilitate removal by flushing to further pulverize the residue as it moves past the bit, and as a result known bits tend to accumulate residue between the bit body and the bore during drilling and this has produced friction therebetween and accompanying binding and twisting of the bits in the bores. Such binding and twisting distorts and in some cases cracks or breaks the bits. For the same reasons the known bits tend to excessively load the drive rods due to the friction and binding and generally require more power than is desired to drive them thereby further increasing the chances of producing the problems indicated. As a result of these conditions the diameter of known bit bodies have often been made substantially smaller than the diameter of the head portion to provide as much space between the bit bodies and the bores as possible for the residue to pass. As this space is increased either the diameter of the head portion increases beyond what is the most desireable condition or the bit body becomes too small and weak. While making the diameter difference large may minimize the chance for a bit binding in a bore it also means that the ratio of the diameter of the bit body to the diameter of the bit head may not be the most desirable or efficient.

Furthermore, no known rock bit has means for agitating and further pulverizing the residue as it moves along the side of the bit body to further reduce the size of the particles in the residue and to facilitate unobstructed movement of the residue from the bore face to the rear of the bit and from there out through the bore. Not only does no known bit include means for pulverzing the residue as it moves past the bit body, the present bit has means at the rear end of the bit for agitating and pulverizing residue that may accumulate behind the bit in the bore. This is especially a problem if the bore slopes downwardly away from the entrance which can make it especially difficult to remove the bit. The present bit has endwardly extending projections on the rear end of the bit body which acts to stir up and agitate the residue that accumulates behind the bit. The present construction therefore has several novel features, as explained, and it has been found in practice that the present bit construction substantially improves the drilling operation, makes the drilling operation more efficient, and with less chance for the bit twisting, binding or breaking, it reduces the driving force necessary to rotate the bit, and the present bit construction is much likely to bind in a bore due to the accummulation of drilling residue around the outer surface of the bit body and behind the bit. The present bit construction therefore operates better and more efficiently than known rock drill bits, is less likely to be damaged and is easier to drill with and to withdraw from bore. The full body construction also increases penetration rate, and leaves a clean hole for inserting the blasting agent.

OBJECTS OF THE INVENTION

It is therefore a principle object of the present invention to provide a bit construction that operates more efficiently than known rock drill bits, is less likely to bind, twist or break during drilling, and one that leaves a clean hole for the blasting agent.

Another abject is to provide a bit with means for circulating and if necessary pulverizing drilling residues that may accummulate between the outer surface of a bit body and the surface of a bore being drilled.

Another object is to teach the construction of a rock drill bit which is relatively simple and easy to manufacture.

Another object is to reduce the time required for drilling holes in rock and like materials.

Another object is to make it easier to remove a rock drill bit from a bore and with less risk of damage to the bit.

Another object is to form axially extending passages along the side wall of a rock drill bit body through which the drilling residue being carried by the drilling fluid can be removed during a drilling operation.

Another object is to reduce frictional forces that can be produced between a rock drill bit and a bore surface being drilled thereby.

Another object is to teach the construction of a rock drill bit which can be used with conventional drilling equipment to increase the rate of drilling and the drilling efficiency.

Another object is to teach the construction of a rock drill bit which can have a more efficient relationship between the drilling diameter and the body diameter.

Another object is to reduce the power required to drive a rock drill bit.

Another object is to reduce the possibility of damaging a rock drill bit due to binding or twisting caused by frictional forces produced between the body of the bit and a bore being drilled.

Another object is to minimize the possibility that a rock drill bit will not be able to be removed from a drilled bore.

Another object is to provide means to produce clean, straight holes for easy placement of a blasting agent.

These and other objects and advantages of the present invention will become apparant after considering the following detailed specification in conjunction with the accompanying drawings.

DESCRIPTION OF PREFERRED EMBODIMENTS

Figure 1:
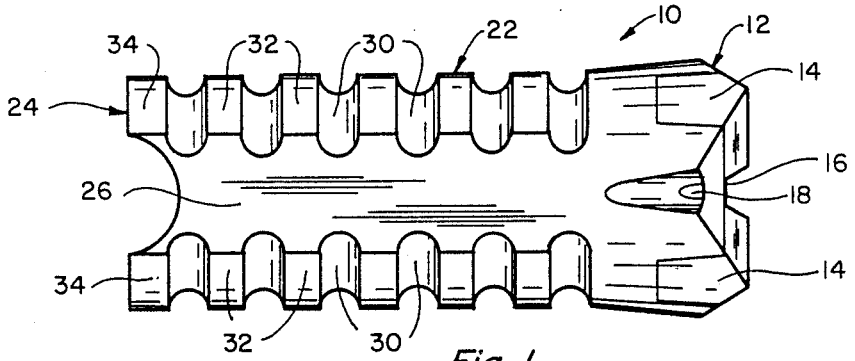
FIG. 1 is a side elelvational view of a rock drill bit constructed according to the teachings of the present invention.

Referring to the drawings more particularly by reference numbers, number 10 in FIG. 1 refers to a rock drill bit constructed according to the teachings of the present invention. The bit 10 includes a head end portion 12 which is the portion that bears against a work surface and does the drilling. The head end of the bit is shown including a plurality of hardened inserts 14 formed of a material such as tungsten carbide or the like, and the head end portion 12 of the bit its also shown having a central opening 16 and four spaced and angularly oriented side openings 18 all of which openings communicate with the interior bore 20 of the bit as shown.

The bit 10 also includes an elongated body portion 22 with the opening 20 which is preferrally a threaded opening (FIG. 3) extending therein from the rear end 24 most of the way to the forward or head end 12. The interior opening 20 is threaded to receive the threaded end portion of a tubular drill rod (not shown) which has drive means connected to it for rotating the bit during a drilling operation. The tubular drive rod also has a flow passage therethrough through which water or some other drilling fluid or coolant is forced during drilling to cool the bit and to carry away the drilling residue as it is generated at the drill face. The drilling fluid flows through the openings 16 and 18 against the face of the bore being drilled and then flows back along the outside surface of the bit body between the bit body 22 and the bore being drilled.

Figure 3:
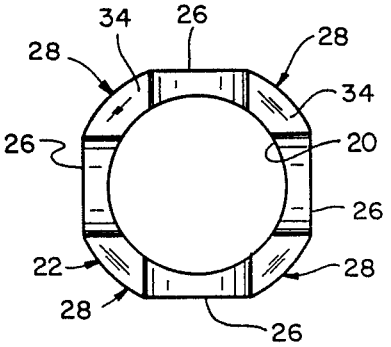
FIG. 3 is a left end view of the rock drill bit of FIG. 1.
Figure 4:
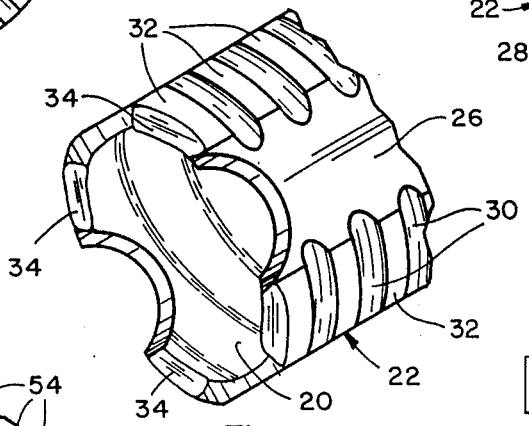
FIG. 4 is a fragmentary perspective view taken from the rear end of the rock drill bit shown in FIG. 1.

Referring to FIGS. 3 and 4 the bit body 22 is shown having an outer surface defined by one or more axially extending flats such as flats 26 extending therealong. Four such flats 26 arranged in opposed pairs are shown for illustrative purposes. The flats 26 divide the outer surface of the bit body into a similar number of outwardly extending rounded body portions 28. The body portions 28 are further modified by a plurality of transversely extending grooves shown as segmented arcuate round bottomed grooves 30 positioned at spaced locations along the body 22. The grooves 30 divide the body portions 28 into a plurality of spaced outwardly extending segmented body portions or teeth 32. When the bit 10 is mounted on a tubular drive rod (not shown) for use in drilling into rock or similar material, drilling fluid will be forced through the rod and out the bit opening 16 and 18 in the head end portion 12. This fluid will come in contact with the drill face and will pick the drilling residue that is being produced flushing it back along the outside of the bit body 22 as aforesaid. The fluid and the residue it carries will be concentrated during such backward movement in the axial spaces formed between the flats 26 and the surface of the bore that is being drilled. The residue including especially any larger particles that are present will move back along the bit body and such residue and particles will be swirled by the rotation of the bits and especially by the action of the rotary teeth 32, and the teeth will operate to further pulverize the residue. This action is aided by the fact that the outwardly extending teeth are spaced and therefore act like hammers with spaces formed therebetween. The further grinding up of the residue produces a significant advantage for the present bit over known bits including those which have cylindrical shaped body portions. This is because the further grinding or pulverizing action on the residue is done with a swirling action that substantially reduces the possibility that any of the residue will accumulate between the bit body and the bore to cause friction and accompanying twisting, binding or even breaking of the drill bit. Twisting, binding and breaking of a drill bit are all very undersirable conditions since they not only substantially increase the power required to rotate the bit but they may also cause the bit to become permanently wedged in the bore resulting in loss of the bit usually in a partially drilled bore that can not be otherwise used. Also when a bit becomes bound up in a bore there is usually a loss of drilling time in replacement of parts and the drill rod may also be damaged and unusable. Once a drill and a bit are lost in a hole they are never retrieved or reuseable.

Figure 2:
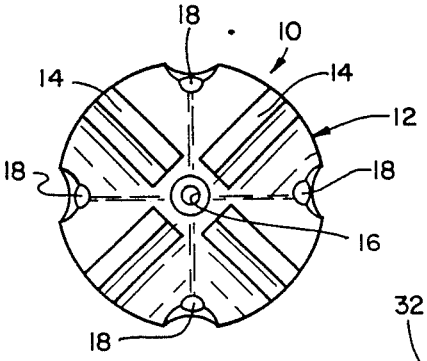
FIG. 2 is a right end view of the rock drill bit of FIG. 1.

Referring to FIGS. 1 and 2 it can be seen that the head end portion 12 of the subject bit 10 is somewhat larger although not substantially larger in diameter than the largest diameter of the body portion 22. This relatively small difference in the case of the present bit is an important advantage over known drill bits that have cylindrical body portions used for the same or similar purposes. This difference in body to head diameter in the present bit can be from no difference at all to a relatively slight difference. This is possible with the present bit because of the passages formed in the bore by the flats 26 combined with the pulverizing action produced by the body teeth portions 32. The flats 26 also provide means to concentrate the flow of fluid and residue which is a further advantage, and the flats operate with the teeth 32 during rotation of the bit to swirl the fluid and residue and increase the pulverizing action, a condition that is clearly not true of bits that have cylindrical body portions.

Another very useful feature of the present bit construction is obtained by the provision of rearwardly projecting body portions 34. These portions are formed as extensions of the rear end of the bit body. The projections 34 are particularly useful when removing the bit 10 from a bore especially in those cases where some of the residue may have accumulated in the bore behind the bit. As indicated this is especially troublesome when the bore slopes downwardly from its entrance. Such accumulations can cause the bit to hang up during withdrawal making it difficult and in extreme cases impossible to remove the bit. This problem is aleviated in the present construction by the action of the projecting body portions 34 which operate to scrape and break up and further pulverize any such blockage that may have accummulated behind the bit in the bore making removal relatively easy. The projections 34 may include hardened inserts to extend their useful life if desired. Thus a bit constructed according to the construction shown in FIGS. 1–4 produces several important advantages including reducing the chance for binding, twisting and breaking during the drilling operation, makes it relatively easy to remove the bit from a bore and leaves a clean straight hole for receiving the blasting agent.

Figure 6:
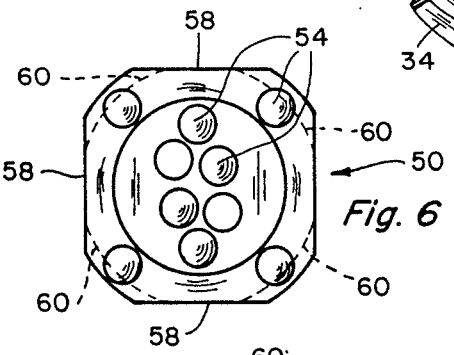
FIG. 6 is a right end view of the modified drill bit of FIG. 5.
Figure 5:
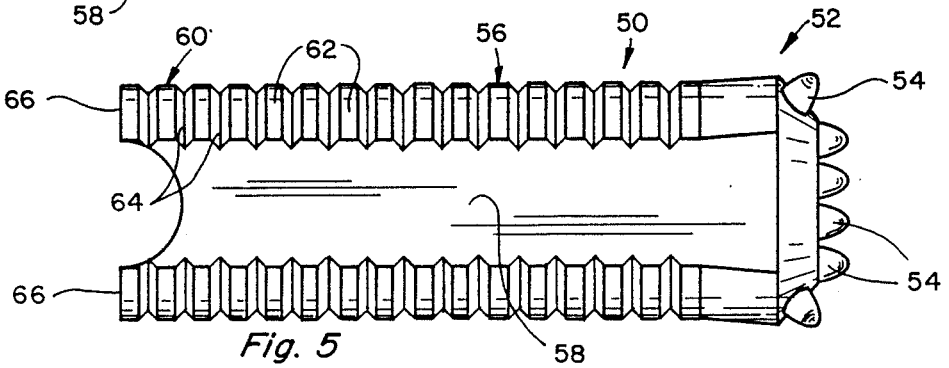
FIG. 5 is a side elevational view showing another embodiment of the subject rock drill bit.

FIGS. 5 and 6 show another embodiment 50 of the subject bit which has many of the same advantages and similar structural features. However, the bit construction 50 differs from the construction 10 in several important respects. For example, the bit 50 has a head portion 52 which had a plurality of spaced hardened teeth 54 attached thereto at various locations as shown. There are a number of different patterns or arrangements for the hardened portions 54 and the particular pattern shown in FIGS. 5 and 6 is only one of many possible variations. The bit 50 has a tubular body portion 56 which is shown having opposed pairs of flat surfaces 58 separated by larger diameter portions 60 which are formed by spaced teeth 62 separated by V-shaped grooves 64 positioned therebetween as shown. The bit 50 also has rearwardly extending portions 66 which serve the same purposes as the rearwardly extending portions 34 in the construction 10. The bit 50 is shown to illustrate a bit having a greater number of teeth portion 62 and a different shape for the grooves 64. Except for these differences and differences between the head ends shown on the constructions 50 and 10 the constructions are similar and operate similarly and have the same advantages. The constructions shown in FIG. 5 may be better adapted for drilling into a different kind of a material than the bit 10 including materials that may be more granular, sandy or even powdery. Except for the differences noted the constructions 10 and 50 are very similar. It is to be understood, however, that applicant has not and makes no claim to having invented a particular distinctive head end portion for his bits and the present bits may have many different shapes and constructions for the head ends thereof.

Figure 7:
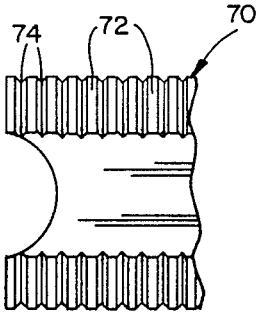
FIG. 7 is a fragmentary side elevational view showing another embodiment of the present device.

FIG. 7 shows another embodiment 70 of the bit 10 wherein the teeth portions 72 and the adjacent groove portions 74 are even finer and closer together. This construction can be used to drill in still different material.

It is contemplated to also construct any of the various embodiments of the subject bits having 1, 2, 3 or even more flats formed on the surface of the body as required. It has been found, however, that 3 or 4 equally spaced flats provides the best operating condition and produces the most desirable operating results.

It has also been discovered that in some cases it is possible to modify the construction of existing bits including especially existing bits having tubular body portions to produce an improved construction such as shown and described above. This can be accomplished by milling or otherwise forming axially extending flats or indentations in the face or surface of the body portion of the existing bit and then producing the desired number and size of grooves to form the spaced high spots or teeth to achieve the desired results. In practice it has been discovered that the use of flats provides a very satisfactory operating condition and one which produces the benefits described above. However, in some cases it may be preferred to form spaced axially grooves in the sides of the bit body and it is contemplated to construct the subject bits in this manner without departing from the spirit and scope of the invention.

Thus, there has been shown and described rock drill novel bit constructions which fulfill all of the objects and advantages sought therefor. It will be apparant to those skilled in the art, however, that many changes, modifications, variations and other uses and applications for the subject bits are possible and all such changes, modifications, variations and other uses and applications which do not depart from the spirit and scope of the invention are deemed to be covered by the invention which is limited only by the claims which follow.

What is claimed is:

1. A rock drill bit comprising an elongated body of tubular cross section rotatable about an axis and having a head end portion closing one end of the body which head end portion engages a drill face to be drilled, said body having an outer surface and an opposite trailing end portion having an opening for receiving a drill rod, the largest transverse dimension of the body being substantially smaller than the length thereof, the head end portion having portions formed or relatively hard material for engaging and drilling the drill face when the bit is rotated, means including at least one opening through the head end portion for drilling fluid to pass to the area around the head end portion, at least two circumferentially spaced axially extending cutouts formed in the outer surface of the bit body forming passages along sustantially the length of the bit body with the surface of a bore being drilled through which drilling fluid and cuttings removed during drilling can pass as it moves away from the drill face, elongated outwardly extending body portions extending along substantially the length of the body between the cutouts and from the head end portion to the trailing end portion and defining the reawardmost points of the drill bit, the outwardly extending body portions having a plurality of axially spaced circumferentially extending grooves dividing the outwardly extending body portions into a plurality of outwardly extending elements, rotation of the bit in a bore causing the elements to rotate in closely spaced relationship to the surface of the bore whereby drilling fluid and cuttings moving along the body in the passages will be swirled and further pulverized by the elements as the bit rotates in the bore, rotation of the head end portion of the bit producing a bore diameter that is somewhat greater than the diameter of rotation of the outwardly extending elements.

2. The rock drill bit of claim 1 wherein there are a pairs of opposed axially extending cutouts formed in the bit body.

3. The rock drill bit of claim 1 wherein the trailing end portion of the bit body includes a plurality of endwardly facing depressions between the outwardly extending body portions, said outwardly extending body portions between the endwardly facing depressions at the trailing end portion forming a plurality of endwardly extending projections, the depressions and projections swirling drilling fluid and cuttings located in the bore behind the bit as the bit is retracted through the bore.

4. A rock drill bit comprising an elongated tubular body having a substantially closed forward end portion including a drill face with a plurality of hard wear resistant elements attached thereto and at least one passage therethrough for drilling fluid to pass through the inside of the body to reach the drill face and an opposite open trailing end for receiving a drill rod, the longest cross sectional dimension of the body being substantially less than the length thereof, said body having a plurality of spaced axially extending surface depressions extending along substantially the length thereof forming elongated passages with the surface of a bore being drilled through which the drilling fluid and residue removed during drilling can pass, spaced elongated outwardly axially extending body portions between the surface depressions and extending from the forward end portion to the opposite open trailing end portion and defining the rearwardmost points of the drill bit, and a plurality of spaced transversely extending surface grooves formed in each outwardly axially extending body portion dividing each of the outwardly extending body portions into a plurality of axially spaced outwardly extending elements.

5. A rock drill bit having an elongated tubular body with a drill head portion closing one end and a trailing opposite open end for receiving a drill rod, the largest transverse dimension of the tubular body being substantially smaller than the length thereof and slightly smaller than the largest transverse dimension of the drill head portion, a passage through the drill head for communicating the open opposite end of the tubular body with a drill face being drilled by the drill head portion, said tubular body having at least two circumferentially spaced axially extending elongated depressions formed in the outer surface thereof and extending between the drill head end portion of the bit body and the trailing opposite end of the body, the depressions forming passageways between the bit body and a bore being drilled, elongated outwardly extending body portions formed between the spaced depressions and extending from the drill head portion to the trailing opposite end and defining the rearwardmost points of the drill bit, and a plurality of spaced transversely extending grooves formed in the outwardly extending body portions subdividing said portions into a plurality of outwardly extending body segments.

6. The rock drill bit of claim 5 wherein the spaced transversely extending grooves in the outwardly extending body portions are round bottomed.

7. The rock drill bit of claim 5 wherein the spaced transversely extending grooves in the outwardly extending body portions are of V-shaped cross-section.

8. The rock drill bit of claim 5 including endwardly facing depressions between the outwardly extending body portions formed on the trailing opposite open end of the tubular body, said outwardly extending body portions between said endwardly facing depressions forming a plurality of endwardly extending projections.

9. The rock drill bit of claim 8 wherein the endwardly extending projections on the opposite end of the bit body include attached hardened portions.

10. A rock drill bit having an elongated tubular body with a drill head portion integral with one end and a trailing opposite open end for receiving a drill rod, a passage through the drill head portion communicating with the open opposite end of the tubular body for the passage of drilling fluid to move from the drill rod into the tubular body and from there to the drill face, said tubular body having at least two axially extending circumferentially spaced elongated portions of reduced diameter formed in the outer surface thereof and extending substantially the length of the drill bit, said tubular body having elongated outwardly axially extending body portions formed between the spaced reduced diameter body portions and extending from the drill head portion to the open opposite end and defining the rearwardmost points of the drill bit, a plurality of spaced transversely extending surface grooves formed in each elongated outwardly axially extending body portions dividing each of the outwardly axially extending body portions into a plurality of axially spaced outwardly extending elements whereby when the drill bit is being rotated during a drilling operation the drilling fluid and the residue removed from the drill face moves through passages formed by and between the spaced reduced diameter body portions and the surface of the bore being drilled, the outwardly extending body portions moving closely adjacent to the surface of a bore being drilled to produce a swirling action on the fluid and the residue carried thereby as it moves along the tubular bit body and produces a pulverizing action thereon, the longest transverse dimension of the tubular body being substantially less than the length of the body.

11. The rock drill bit of claim 10 including means forming spaced endwardly facing depressions between the outwardly extending body portions on the opposite open end of the bit body, said outwardly extending body portions between the endwardly facing depressions at the opposite open end forming a plurality of endwardly extending projections.

12. The rock drill bit of claim 10 wherein the largest transverse dimension of the tubular body is substantially the same as the largest transverse dimention of the drill head portion.

13. The rock drill bit of claim 10 wherein the largest transverse dimension of the tubular body is somewhat smaller than the largest transverse dimension of the head portion.

* * * * *

UNITED STATES PATENT AND TRADEMARK OFFICE

CERTIFICATE OF CORRECTION

PATENT NO. : 4,953,642

DATED : September 4, 1990

INVENTOR(S) : Roger D. Skaggs

It is certified that error appears in the above—identified patent and that said Letters Patent is hereby corrected as shown below:

Col. 1, line 7 "an" should be --and--.

Col. 2, line 31 after "much" insert --less--.

Col. 2, line 37 after "from" insert --a--.

Col. 2, line 47 "abject" should be --object--.

Col. 3, line 23 "elelvational" should be --elevational--.

Col. 3, line 49 "its" should be --is--.

Col. 5, line 18 "accummulated" should be --accumulated--.

Col. 5, line 32 "had" should be --has--.

Col. 6, line 42 "or" should be --of--.

Col. 6, line 49 "sustanially" should be --substantially--.

Col. 6, line 56 "reawardmost" should be --rearwardmost--.

Signed and Sealed this

Twenty-sixth Day of November, 1991

*Attest:*

HARRY F. MANBECK, JR.

*Attesting Officer*

*Commissioner of Patents and Trademarks*